United States Patent [19]

Wallace

[11] 3,971,270

[45] July 27, 1976

[54] TWEEZERS

[76] Inventor: Joseph T. Wallace, 4401 Juniper, Tempe, Ariz. 85282

[22] Filed: June 2, 1975

[21] Appl. No.: 582,595

[52] U.S. Cl. ..... 81/43
[51] Int. Cl.[2] ..... B25B 9/02
[58] Field of Search ..... 81/43; 128/354; 294/99

[56] References Cited

UNITED STATES PATENTS

| | | | |
|---|---|---|---|
| 581,810 | 5/1897 | Clarkson | 81/43 |
| 759,668 | 5/1904 | Carlsen | 81/43 |
| 3,167,981 | 2/1965 | Kern | 81/43 |

*Primary Examiner*—Al Lawrence Smith
*Assistant Examiner*—Roscoe V. Parker

[57] ABSTRACT

Tweezers which are particularly adapted for handling stamps or other objects wherein a pair of tweezer members are secured together. Each tweezer member having a butt end and a finger portion terminal end. Each tweezer member having a substantially concavo-convex handle portion with a concave sides of the handle portion being opposed to each other and whereby each finger portion of each tweezer member is substantially straight and a transition portion between the finger portions and the handle portion provides a fulcrum by means of which the finger portions may be pivoted apart by opposed pressure on the convex sides of the concavo-convex handle portions of the tweezer members. The butt ends of the tweezer members being normally converging toward said butt ends relative to each other and being secured together in substantially parallel preloaded relationship such that the finger portions of the tweezer members are held in contiguous clamped together relationship and wherein the aforementioned transition portions operate as fulcrums for separating the finger portions of the tweezer members at their terminal ends so as to pick up stamps or other objects as desired.

10 Claims, 6 Drawing Figures

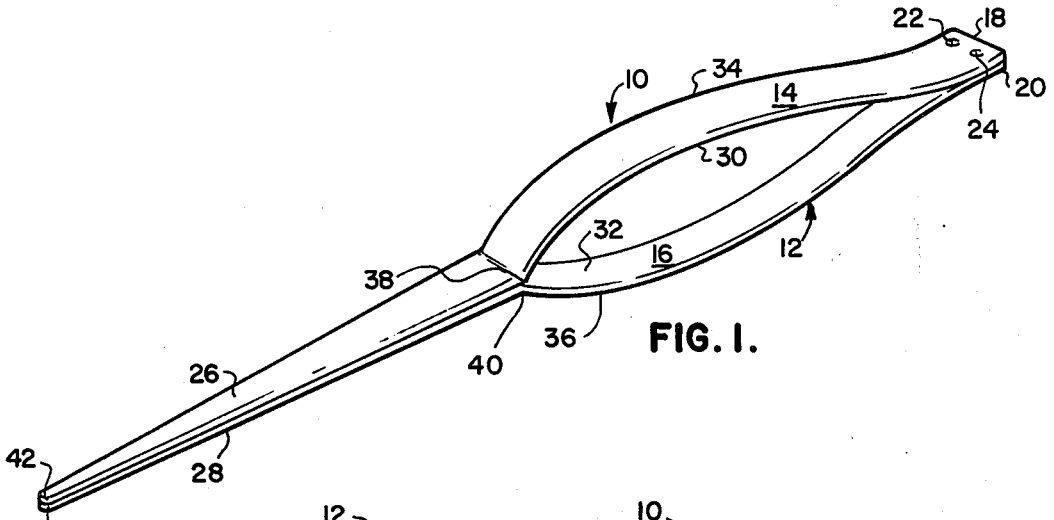
FIG. 1.
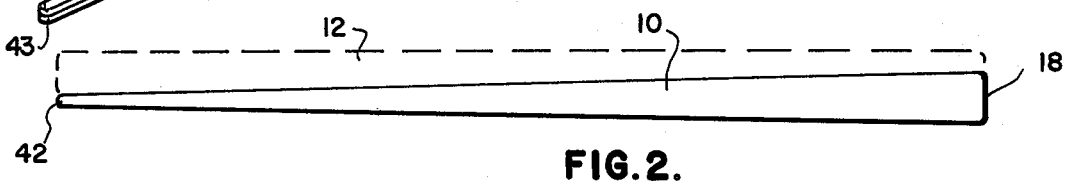
FIG. 2.
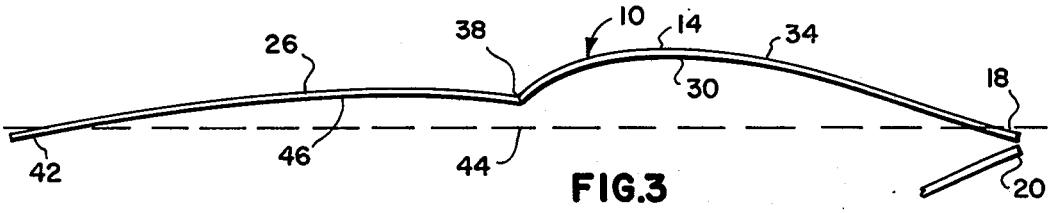
FIG. 3
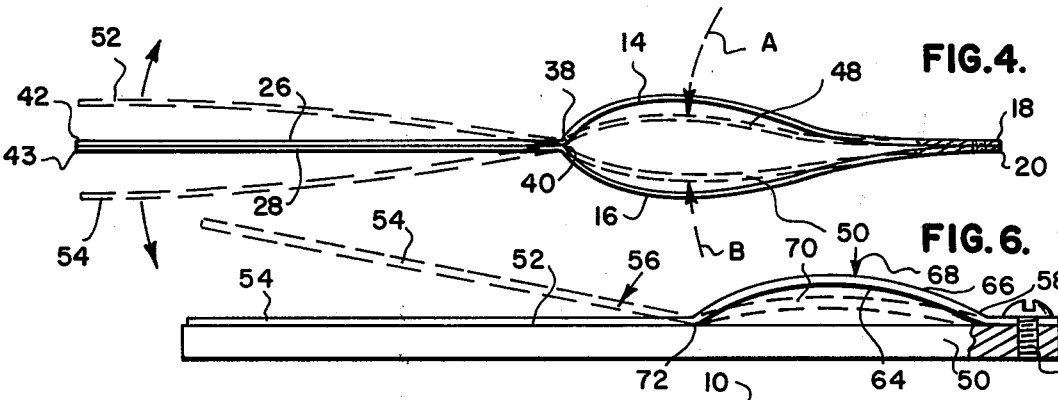
FIG. 4.
FIG. 6.
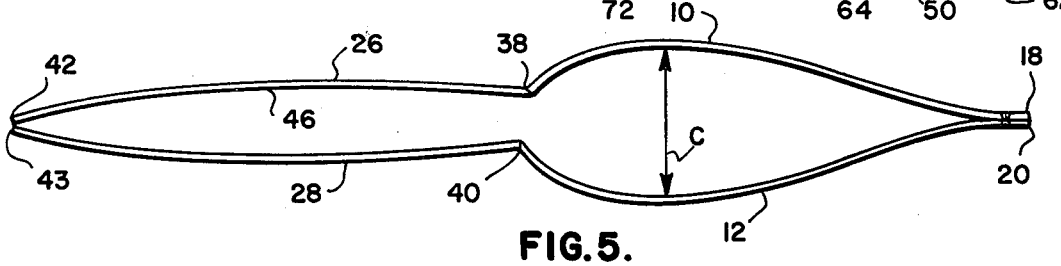
FIG. 5.

TWEEZERS

BACKGROUND OF THE INVENTION

Various tweezers have been utilized for many purposes and operations and most of the prior art tweezers rely upon manual force to force the gripping terminal ends of the tweezer members together at opposite sides of an object being handled or picked up. Such tweezers have heretofore been used in relation to the handling of delicate objects such as stamps or the like and the operator of conventional tweezers may at times exert too much pressure on conventional tweezers and cause damage to some delicate article such as stamps or the like and the prior art tweezers have been provided a small point contact portions at the terminal ends such that it is difficult to control the unit pressure applied to an object being picked up when the tweezer fingers must be forced together manually when operated.

SUMMARY OF THE INVENTION

The present invention comprises tweezers having finger portions which have substantially elongated contiguous engaging portions which are straight and flat and which are preloaded together with a predetermined amount of resilient force whereby the unit pressure of the opposed tweezer fingers on an object such as a fragile stamp or the like is not excessive.

Additionally, the invention comprises a novel structural arrangement of tweezers wherein finger pressure is utilized to open the tweezers and resilient action of the material of the tweezer members closes the tweezer fingers together at opposite sides of an object being handled thereby providing for a uniform gripping force which is completely independent of the pressure applied by a person's fingers when operating the tweezers.

The invention comprises a pair of tweezer members having opposed concavo-convex handle portions and relatively straight finger portions integral therewith. The concavo-convex portions of the finger members being opposed such that the concave sides of the concavo-convex portions face each other and provide a space which may be resiliently collapsed over the center of transition portions between the handle portions and finger portions. The transition portions acting as fulcrums to pivot the finger portions into relatively open diverging position relative to each other such that the finger portions may be positioned at opposite sides of an object to be picked up whereupon release of pressure on the concavo-convex handle portions permits the resilient action of the material of the tweezers to close the finger portions and engage opposite sides of the object being picked up therebetween.

Accordingly, it is an object of the invention to provide tweezers which may engage opposite sides of a delicate object such as a stamp and whereby the uniform pressure of the fingers at opposite sides is nominal and predetermined to prevent damage of the stamp when handled by the tweezers.

Another object of the invention is to provide tweezers wherein a pair of relatively extensive straight finger members are resiliently held contiguous to each other in normal position and whereby when disposed at opposite sides of a stamp and holding the stamp therebetween may provide for straight, flat disposition of the stamp while being examined by persons holding the stamp by means of the tweezers.

Another object of the invention is to provide tweezers which are very simple and economical in construction, very durable and which have predetermined gripping force so as to provide for delicate handling of various objects.

Another object of the invention is to provide a novel construction of tweezers wherein relatively converging butt ends of tweezer members are pre-loaded and fixed together in substantially flat parallel position so as to provide pre-loading of the handle portion of the tweezer members which comprise opposed concavo-convex portions which may be resiliently collapsed toward each other and which have fulcrum portions integral with which finger portions are disposed so that when the concavo-convex portions are collapsed toward each other the fulcrum portions engage and the finger portions are pivoted to open position about the fulcrum portions.

Another object of the invention is to provide tweezer wherein the tweezer members are generally tapered members made of sheet metal or other resilient material whereby the tweezer members may be sheared in such a manner that no waste material is produced during the blanking of the tweezer members from said sheet metal or other such material.

Another object of the invention is to provide a novel method of fabricating tweezers.

Further objects and advantages of the invention may be apparent from the following specification, appended claims and accompanying drawings.

BRIEF DESCRIPTION OF THE DRAWINGS

FIG. 1 is a perspective view of tweezers constructed in accordance with the present invention;

FIG. 2 is a flat side view of tweezers manufactured in accordance with the present invention;

FIG. 3 is a fragmentary edge view of a pair of tweezer members showing the general geometry thereof before assembly into a pair of tweezers;

FIG. 4 is an edge view of a pair of tweezers in accordance with the invention showing a closed position of the tweezer fingers and illustrating by broken lines a relatively open position of the tweezer fingers;

FIG. 5 is another view of the tweezers as shown in FIG. 4 showing the handle portions expanded and showing the preloaded relationship of the finger portions of the tweezers to illustrate the contact of the terminal ends of the tweezer members and their action resulting from a tapered sectional gradient of the finger portions of the tweezer members; and FIG. 6 is a modification of the invention showing a single resilient member.

DESCRIPTION OF THE PREFERRED EMBODIMENTS

As shown in FIG. 1 of the drawings, the tweezers of the invention comprise a pair of tweezer members 10 and 12 having handle portions 14 and 16 respectively. These handle portions 14 and 16 are provided with respective butt ends 18 and 20 which are secured together by spot welds 22 and 24, however, these butt ends 18 and 20 may be secured together by other means as desired as will be hereinafter described.

Integral with the handle portions 14 and 16 are finger portions 26 and 28 respectively.

The handle portions as shown in FIG. 1 are generally concavo-convex in shape and are provided with concave portions 30 and 32 respectively. These concavo-convex portions 14 and 16 are provided with convex portions 34 and 36 respectively with the concave portions 30 and 32 facing each other and forming transitions 38 and 40 with the respective finger portions 26 and 28 which are relatively straight.

As shown in FIGS. 1 and 2 of the drawings, the shape of the tweezer portions 10 and 12 comprises straight tapered geometry wherein the butt end 18 is relatively wide compared to the terminal end 42 of the tweezer member 10 as shown in FIG. 2 and inasmuch as the tweezer members 10 and 12 are substantially identical, the respective tweezer member 12 as shown by broken lines in FIG. 2 may be sheared in adjacent relationship to the tweezer member 10 from a piece of flat stock such as resilient steel whereby no waste material is formed when shearing the individual tweezer members.

With reference to FIG. 3, the tweezer member 10 is formed with its concavo-convex portion 14 such that the concave portion 30 thereof is spaced from a straight plane as indicated by broken lines 44. The transition portion 38 between the handle portion 14 and the finger portion 26 is substantially spaced from the reference plane 44 while the butt end 18 is directed at an acute angle across the reference plane 44 and the terminal end 42 of the finger portion 26 is slightly disposed across the plane 44 while the general cross section of the finger portion 26 is slightly curved providing a concave surface 46 at a side corresponding to the concave portion 30 of the handle portion 34.

Also shown in FIG. 3 is the butt end portion 20 of the tweezer member 16 and it will be seen that these butt end portions 18 and 20 are initially in a converging relationship to each other toward said butt ends and that when they are forced together in parallel relationship as shown in FIG. 4, they are welded by the spot welds 22 and 24 and thus the resilient material of the tweezer members 10 and 12 is preloaded so as to force the terminal ends 42 and 43 of the tweezer members 10 and 12 together and due to the tapered cross section of the finger portions 26 and 28 they deflect uniformly into flat contiguous contact relation with each other as shown in FIG. 4 of the drawings, and the fulcrum portions 38 and 40 are thus forced into close contiguous relation to each other whereby force in opposite directions as indicated by arrows A and B in FIG. 4 of the drawings when applied to the handle portions 10 and 12 at their convex surfaces 34 and 36 will cause the fulcrum portions 38 and 40 to bear upon each other and deflection of the concavo-convex portions 14 and 16 to respective broken line positions 48 and 50 causes the finger portions 26 and 28 to be divergingly spread apart into respective broken line positions 52 and 54 whereby these finger portions may be placed on opposite sides of an object to be picked up and then with the release of pressure in the opposite direction to the arrows A and B will allow the resilient preloading of the tweezer members 10 and 12 to force the finger portions 26 into contact with each other initially at the terminal ends 42 and 43 and then progressively to deflect these finger portions into flat straight contiguous relationship with each other as shown in FIG. 4. It will be understood that the tapered cross section of the finger portions 26 and 28 from their terminal portions 42 and 43 to the relatively broad handle portions 14 and 16 will cause progressive deflection of the finger portions from the curved condition, as shown in FIGS. 3 and 5, to the relatively flat, straight contiguous arrangement shown in FIG. 4 of the drawings.

As shown in FIG. 5, and as indicated by an arrow C, the handle portions 10 and 12 when forced apart a certain distance will reveal the curved relationship of the finger portions 26 and 28 and particularly as shown in FIG. 5, the terminal ends 42 and 43 of the finger portions 26 and 28 may be varying in contact while the curved portions 46 are oppositely disposed from each other in generally concave facing relationship. Thus it will be seen how the geometry of the fingers 26 and 28 changes with deflection which occurs progressively from the terminal ends 42 and 43 all the way back to the fulcrum portions 38 and 40 as the separating force indicated by the arrow C is relieved. Conversely when pressure is relieved from the handle portions 14 and 16 in the direction of the arrows A and B, the fingers 26 come together in somewhat the same manner as shown in FIG. 5 and gradually straighten into straight contiguous relationship with each other due to a deflection gradient compatible with the tapered cross section of these finger portions 26 and 28.

The curvature of the finger portions 26 and 28 is slightly exaggerated for purposes of disclosure and will, of necessity, be dictated by the length of the fingers 26 and 28 as well as their graduated cross sectional structure from the terminal ends 42 and 43 to the butt ends 18 and 20 respectively and also in accordance with the resilient preload accomplished by the securing of the normally rearward converging portions at the butt ends 18 and 20 as they are spot welded together in relatively parallel relationship to each other as shown in FIGS. 1, 4 and 5 of the drawings.

When a thin member such as a stamp or other item is grasped between the finger portions 26 and 28 in broken line positions as shown in FIG. 4 and when the pressure is relieved on the handle portions 10 and 12 the fingers 26 and 28 come together in straight, flat contiguous relationship to each other and are capable of engaging a considerable area of a stamp without imposing undue concentration of pressure at any particular area thus avoiding damage to a stamp or other delicate item being handled by the tweezers.

The relative thickness of the tweezer members 10 and 12 at their handle portions 14 and 16 and the resilient character of the material used may permit almost complete collapsing of the handle portions against each other without causing a set in the materials of the tweezer members 10 and 12 and thus rendering it substantially impossible to damage the tweezers by normal finger pressure on the handle portions 14 and 16.

The invention comprises a novel method of assembling tweezers wherein a pair of tweezer members such as shown in FIG. 3 are formed with concavo-convex handle portions 10 and 12 with integral finger portions 26 and 28 with transitions of the handle portions and finger portions being at 38 and 40. Then the rearward converging portions of the butt ends 18 and 20 of the tweezer members are forced together in parallel relationship to each other thereby preloading the finger portions 26 and 28 toward each other and then securing said butt ends in substantially parallel relation to each other.

In the modification as shown in FIG. 6 of the drawings, one of the tweezer members is shown fixed to a base 50. This base 50 is a substantially rigid base having a clamping surface 52 adjacent to which a finger portion 54 of a resilient clamping member 56 is adapted to be held contiguous by means of a preloaded portion 58 of the resilient clamping member near its butt end 60.

The configuration of the clamping member 56 is similar to that of the tweezer member 10 shown in FIG. 3 of the drawings and a screw 62 holds the clamping member 56 in resiliently loaded relationship to the surface 52 of the base 50 so as to maintain the finger portion 54 in contiguous parallel relationship therewith.

The resilient clamping member 56 is provided with concave and convex portions 64 and 66 respectively. The concave portion 64 being in facing relation with the surface 52 of the substantially rigid member 50 whereby pressure as indicated by the arrow 68 on the convex portion 66 deflects the concavo-convex portion to a broken line position 70 thereby causing the fulcrum portion 72 between the concavo-convex portion and the finger portion 54 to bear on the surface 52 and to provide for cantilevered deflection of the finger portion 54 to the broken line position as shown in FIG. 6 whereby subject matter to be held between the finger portion 54 and the surface 52 may be inserted therebetween when the finger portion 54 is in the broken line position as shown in FIG. 6 of the drawings.

Accordingly, it will be appreciated that a single resilient clamping member having identical structure to one of the tweezer members 10 and 12 may be secured to a rigid base and utilized thereon such as may be required in connection with clip boards or other similar utility devices.

It will be obvious to those skilled in the art that various modifications may be resorted to without departing from the spirit of the invention.

I claim:

1. In a tweezer structure, the combination of: a pair of resilient tweezer members; each tweezer member having a handle portion provided with an integral finger portion; each handle portion having a butt end and said finger portion having a terminal end; said handle portion having a substantially concavo-convex portion integral therewith; said concavo-convex portion having a concave side and a convex side; said concavo-convex portion being integral with said finger portion; each finger portion having substantially straight configuration relative to said substantially concavo-convex portion; a transition portion disposed between said concavo-convex portion and said finger portion; said pair of tweezer members fixed together in resiliently loaded relation to each other at their butt ends; said concave sides facing each other; said transition portions being in close proximity to each other; said substantially straight finger portions being in resiliently loaded parallel contiguous relationship to each other; whereby opposed pressure on said convex sides of said concavo-convex portion causes said transition portions to engage each other and act as fulcrums and whereby said opposed pressure deflects said concave sides toward each other and pivots said finger portions apart at their terminal ends and beyond said transition portions.

2. The invention as defined in claim 1, wherein: said handle portions are normally converging relative to each other in a direction toward said butt end; said finger portions normally converging toward each other in a direction toward said terminal ends and thus said tweezer members are resiliently loaded when fixed together in generally parallel relation to each other adjacent said butt ends; said handle portions being fixed together in substantially parallel relation to each other adjacent said butt ends; and said finger portions being thus resiliently held in contiguous relation to each other.

3. The invention as defined in claim 1, wherein: said finger portions are slightly curved, when disassembled, between said handle portions and said terminal ends of said finger portions.

4. The invention as defined in claim 3, wherein: said finger portions each having a structural stiffness gradient increasing from said terminal ends toward said handle portion whereby a corresponding flexural gradient from said terminal ends toward said handle portion provides for uniform deflection and contiguous contact of said substantially curved portions initially at said terminal ends and progressively toward said handle portions during closing action of said finger portions toward each other to attain said substantially straight configuration.

5. The invention as defined in claim 1, wherein: said tweezer members are substantially identical to each other.

6. The invention as defined in claim 5, wherein: said tweezer members being tapered convergingly from said butt ends toward said terminal ends.

7. The invention as defined in claim 6, wherein: said tweezer members are of resilient sheet metal of a substantially uniform thickness from said butt ends to said terminal ends.

8. The invention as defined in claim 1, wherein: said butt ends are fused together.

9. The invention as defined in claim 2, wherein: said butt ends are fused together.

10. Apparatus comprising: a substantially rigid base; a resilient clamping member provided with a handle portion having an integral finger portion; said handle portion having a butt end and said finger portion having a terminal end; said handle portion having a substantially concavo-convex portion integral therewith; said concavo-convex portion having a concave side and a convex side; said concavo-convex portion being integral with said finger portion; said finger portion having a substantially straight configuration relative to said substantially concavo-convex portion; a transition portion disposed between said concavo-convex portion and said finger portion; said resilient clamping member fixed to said base in resiliently loaded relationship thereto at said butt end of said handle portion; said concave side facing said base; said transition portion bearing on said base; said substantially straight finger portion being in resiliently loaded parallel contiguous relation to said base; whereby pressure on said convex side of said concavo-convex portion causes said transition portion to bear on said base and act as a fulcrum and whereby said pressure deflects said concave side toward said base and pivots said finger portion away from said base at said terminal end and beyond said transition portion.

* * * * *